US008913946B2

(12) United States Patent
Sawano et al.

(10) Patent No.: US 8,913,946 B2
(45) Date of Patent: Dec. 16, 2014

(54) IMAGE FORMING APPARATUS

(71) Applicants: Shigeru Sawano, Toyokawa (JP); Masashi Kawai, Toyohashi (JP); Naoki Nonoyama, Toyokawa (JP)

(72) Inventors: Shigeru Sawano, Toyokawa (JP); Masashi Kawai, Toyohashi (JP); Naoki Nonoyama, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 0 days.

(21) Appl. No.: 13/846,146

(22) Filed: Mar. 18, 2013

(65) Prior Publication Data

US 2013/0259554 A1 Oct. 3, 2013

(30) Foreign Application Priority Data

Apr. 2, 2012 (JP) ..... 2012-084206

(51) Int. Cl.
*G03G 15/00* (2006.01)

(52) U.S. Cl.
CPC ..... *G03G 15/6529* (2013.01); *G03G 15/6511* (2013.01); *G03G 2215/00396* (2013.01)
USPC ..... 399/381; 399/388; 399/393; 271/9.08

(58) Field of Classification Search
USPC ..... 399/381, 388, 393; 271/10.01, 22, 21, 271/130, 9.08, 24; 400/88
See application file for complete search history.

(56) References Cited

U.S. PATENT DOCUMENTS

| | | | | |
|---|---|---|---|---|
| 5,961,113 | A * | 10/1999 | Morris | 271/22 |
| 2005/0180799 | A1* | 8/2005 | Maekawa et al. | 400/625 |
| 2005/0180802 | A1* | 8/2005 | Maekawa et al. | 400/625 |
| 2011/0228250 | A1* | 9/2011 | Xie et al. | 356/4.04 |

FOREIGN PATENT DOCUMENTS

| | | | |
|---|---|---|---|
| JP | 8-314333 | A | 11/1996 |
| JP | 2003-127484 | | 8/2003 |
| JP | 2006-298616 | A | 11/2006 |

OTHER PUBLICATIONS

Notice of Reasons for Rejection issued in corresponding Japanese Patent Application No. 2012-084206, mailed Jul. 29, 2014 and English translation.

* cited by examiner

*Primary Examiner* — Matthew G Marini
(74) *Attorney, Agent, or Firm* — Buchanan Ingersoll & Rooney P.C.

(57) ABSTRACT

An image forming apparatus that is orientatable in either a first position or a second position, the second position being different from the first position in inclination with respect to a horizontal plane, comprising: a platform configured to be stacked with a plurality of recording sheets used for image formation; a pickup roller in contact with the recording sheets and configured to pick up the recording sheets one at a time; a pressing member applying pressure to the platform against the pick-up roller; and a pressure changer causing the pressing member to change an amount of the pressure according to whether the image forming apparatus is in the first position or in the second position.

2 Claims, 7 Drawing Sheets

IMAGE FORMING APPARATUS

CROSS-REFERENCE TO RELATED APPLICATIONS

This application is based on application No. 2012-84206 filed in Japan, the contents of which are hereby incorporated by reference.

BACKGROUND OF THE INVENTION (1) Field of the Invention

The present invention relates to image forming apparatuses such as printers, and in particular to an image forming apparatus that is orientatable in different positions.

(2) Related Art

Generally, an image forming apparatus such as a printer has a paper feed tray that assumes a substantially horizontal position when the apparatus is set up. In such an image forming apparatus, a pickup roller picks up one recording sheet at a time from a plurality of recording sheets stored in the paper feed tray and transports the recording sheet, on which an images will be formed.

Japanese Patent Application Publication No. 2006-298616 discloses a lifter designed for stable paper feeding. The lifter lifts up a sheet loading plate loaded with the recording sheets, so that the recording sheets are pressed against the pickup roller. The lifter includes: a first elastic member that rotates a turnable pressurizing plate by linear elastic force, the pressurizing plate lifting up the sheet loading plate; and a second elastic member that rotates the sheet loading plate by nonlinear elastic force. The first elastic member and the second electric member cause the pickup roller to apply paper feed pressure against the recording sheets loaded on the sheet loading plate.

Meanwhile, considering the space occupied by the apparatus in an office or home, research for developing an image forming apparatus that can be orientated not only in the horizontal position with the paper feed tray assuming a substantially horizontal position, but also in an upright position, which is the position raised up from the horizontal position by substantially 90° (e.g. Japanese Patent Application Publication No. H08-314333).

However, a conventional image forming apparatus orientated in the upright position often causes a paper feed failure such as multiple feed. Multiple feed is a problem that the apparatus cannot separate one recording sheet from the recording sheets loaded in the paper feed tray, and transports several sheets at a time.

SUMMARY OF THE INVENTION

In view of the above-described problem, the present invention aims to provide an image forming apparatus that is orientatable in different positions and prevents a paper feed failure as much as possible in every position.

One aspect of the present invention is an image forming apparatus that is orientatable in either a first position or a second position, the second position being different from the first position in inclination with respect to a horizontal plane, comprising: a platform configured to be stacked with a plurality of recording sheets used for image formation; a pickup roller in contact with the recording sheets and configured to pick up the recording sheets one at a time; a pressing member applying pressure to the platform against the pick-up roller; and a pressure changer causing the pressing member to change an amount of the pressure according to whether the image forming apparatus is in the first position or in the second position.

Another aspect of the present invention is an image forming apparatus orientatable in either a first position or a second position, the second position being different from the first position in inclination with reference to a horizontal plane, comprising: a platform configured to be stacked with a plurality of recording sheets used for image formation; a pickup roller in contact with the recording sheets and configured to pick up the recording sheets one at a time; a pressing member applying pressure to the platform against the pick-up roller; and a pressure changer causing the pressing member to change an amount of the pressure according to a user's operation associated with whether the image forming apparatus is in the first position or in the second position.

BRIEF DESCRIPTION OF THE DRAWINGS

These and the other objects, advantages and features of the invention will become apparent from the following description thereof taken in conjunction with the accompanying drawings which illustrate a specific embodiment of the invention.

In the drawings:

FIGS. 3A and 3B show that the printer 10 is in the horizontal position and FIG. 3C shows that the printer 10 is in the upright position;

FIG. 4A shows that the printer 10 is in the horizontal position, and FIG. 4B shows that the printer 10 is in the upright position;

FIG. 5A shows that the printer is in the horizontal position, and FIG. 5B shows that the printer is in the upright position;

FIGS. 6A and 6B show that the printer 10 is in the horizontal position and FIG. 6C shows that the printer 10 is in the upright position; FIG. 7A shows that the printer 10 is in the horizontal position and FIG. 7B shows that the printer 10 is in the upright position.

DESCRIPTION OF PREFERRED EMBODIMENTS

The following describes embodiments of an image forming apparatus pertaining to the present invention, taking as an example a printer that forms images by electrophotographic.

Embodiment 1

Figure 1:
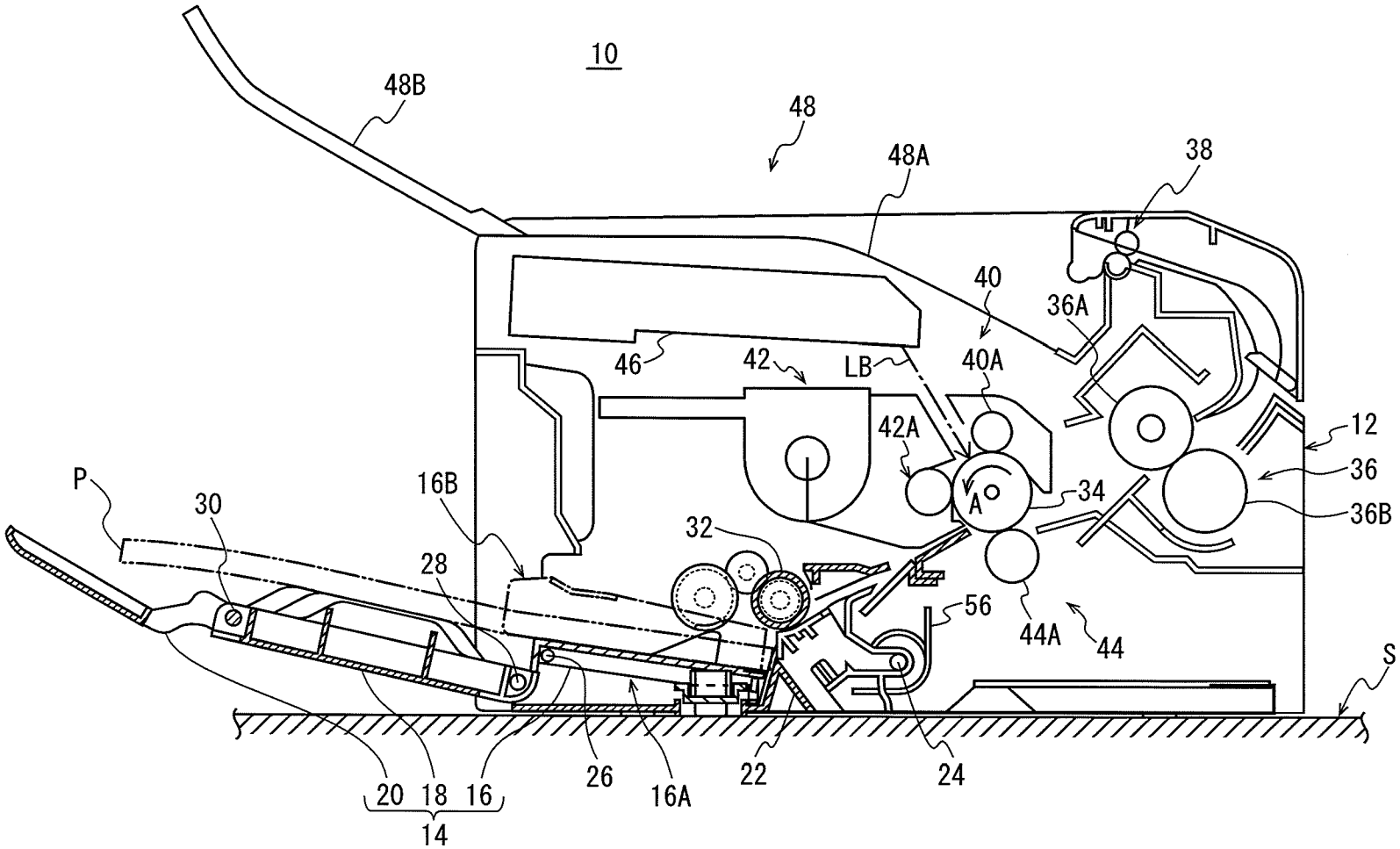
FIG. 1 is a diagram showing an overall structure of a printer 10 pertaining to Embodiment 1 orientated in the horizontal position.

FIG. 1 shows an overall structure of a printer 10 pertaining to Embodiment 1. As described later, the printer 10 is orientatable in either the horizontal position or the upright position. In the horizontal position, a paper feed tray for storing recording sheets and a catch tray for receiving recording sheets on which images have been formed are orientated in their vertical positions so as to be located one above the other. In the upright position, the paper feed tray and the catch tray are orientated in their upright positions so as to be located side by side.

FIG. 1 shows the printer 10 in the horizontal position installed on an installation surface S.

The printer 10 has a casing 12 that is substantially rectangular parallelepiped. A paper feed tray 14 is provided on the casing 12 such that part of the paper feed tray 14 protrudes from the casing 12 in a substantially horizontal direction.

The paper feed tray 14 is composed of a first tray 16, a second tray 18 and a third tray 20. These three trays, namely the trays 16, 18 and 20, are directly or indirectly attached to a frame 20 that is rotatably supported by the casing 12. The frame 22 is supported by the main body of the casing 12 rotatably about a shaft 24. The frame 22 is a part of the casing 12.

In the paper feed tray 14, recording sheets P used for image formation are set as indicated by the two dotted lines in the drawing.

The first tray 16 has a lift-up plate 16A formed by folding down three sides of a rectangular metal plate. The folded sides of the metal plate correspond to the front end, the rear end, and the left end in the perpendicular direction to the drawing sheet. The lift-up plate 16A is supported by the frame 22 rotatably about the shaft 26. As shown in the drawing, the shaft 26 is located near the left folded side and between the folded sides opposing each other in the perpendicular direction to the drawing sheet. A pair of guide plates 16B are provided near the front and rear ends of the upper surface of the lift-up plate 16 in the perpendicular direction to the drawing sheet. These guide plates 16 B guide both edges of the recording sheets P in its widthwise direction (i.e. the perpendicular direction to the transport direction).

The lift-up plate 16A presses the front end of the recording sheets P in the paper feed direction (i.e. the transport direction) toward the pickup roller 32. The mechanism for generating this pressure will be described later.

The second tray 18 is attached to the frame 22 rotatably about the shaft 28.

The third tray 20 is attached to the second tray 18 rotatably about the shaft 30.

When the printer 10 is not in use or when it is to be transported, the second tray 28 and the third tray 20 can be housed inside the casing 12 by rotating the third tray 20 by approximately 180° clockwise about the shaft 30 to the second tray, and rotating the second tray 18 by approximately 90° clockwise about the shaft 28.

On the transport passage of the recording sheet P from the paper feed tray 14 to the catch tray 48 described later, the pickup roller 32, a photosensitive drum 34, a fixing device 36 having a fixing roller 36A and a pressing roller 36B, and a pair of ejection rollers 38 are provided in the stated order.

Also, around the photosensitive drum 34, a charging device 40 having a charging roller 40A, a developing device 42 having a developing roller 42A, and a transfer device 44 having a transfer roller 44A are provided in the stated order. Furthermore, an exposure device 46 for exposing the surface of the photosensitive drum 34 located between the charging roller 40A and the developing roller 42A is housed in the top left part of the casing 12.

The catch tray 48 is composed of a main body 48A and an auxiliary catch tray 48B. The main body 48A is a part of the upper surface of the casing 12. An auxiliary catch tray 48B is made from a removable plate, one end of which is inserted into the casing 28.

In the printer 10 having the stated structure, the photosensitive drum 34 rotated by a driving device (not depicted) in the direction indicated by the arrow A is uniformly charged by the charging device 40, and then exposed to a laser beam LB modulated by the exposure device 46. An electrostatic latent image formed on the surface of the photosensitive drum 34 by exposure is made visible as a toner image by the developer 42.

Meanwhile, the recording sheet P supplied from the paper feed tray 14 is transported to the area between the photosensitive drum 34 and the transfer roller 44A. Due to the electric field generated by the transfer roller 44A, the toner image on the photosensitive drum 34 is transferred onto the recording sheet P.

The toner image transferred onto the recording sheet P is fixed on the recording sheet P by heat and pressure applied to the recording sheet P by the fixing device 36. The recording sheet P, on which the toner image has been fixed, is ejected onto the catch tray 48 by the pair of ejection rollers 38.

Figure 2:
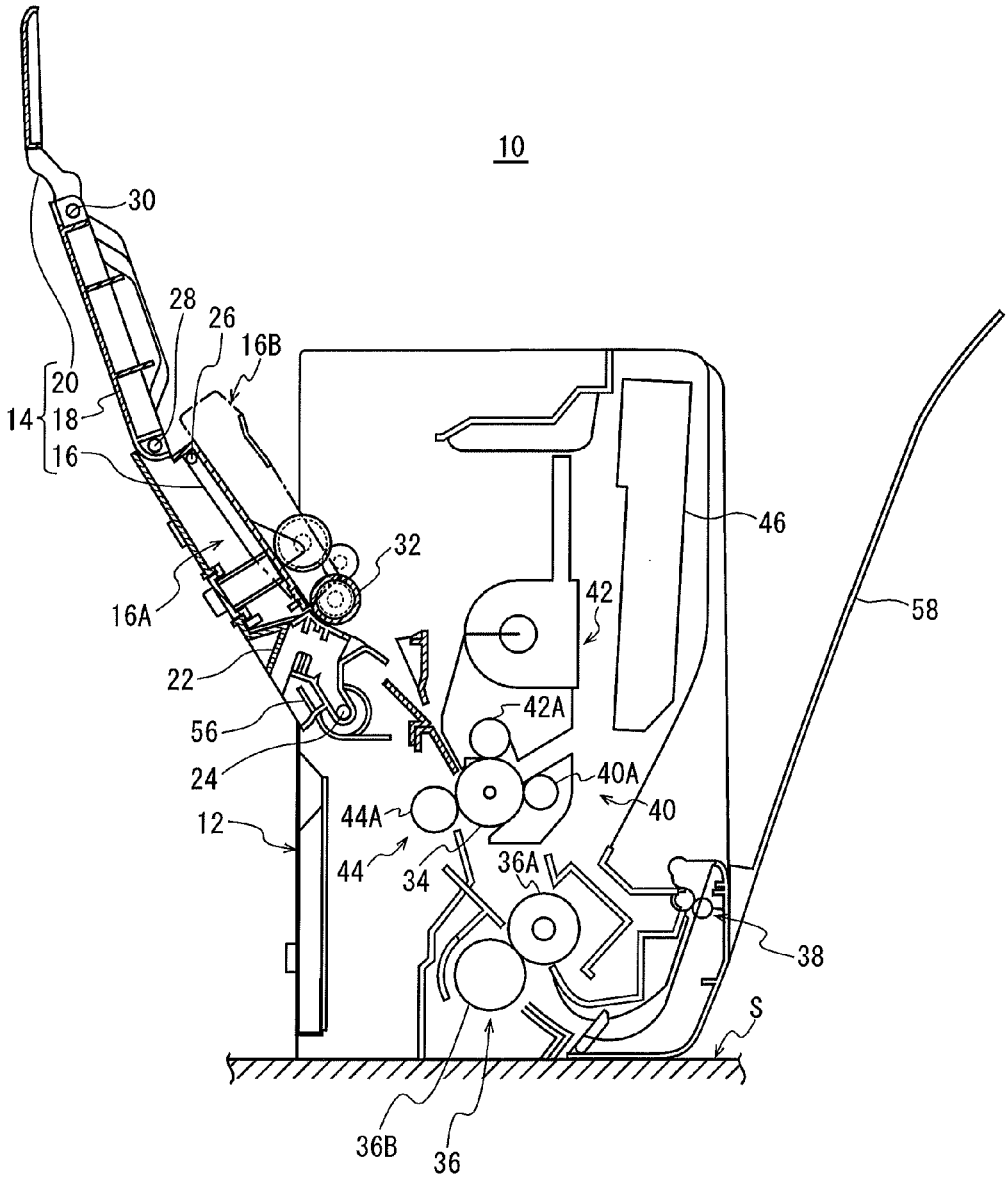
FIG. 2 is a diagram showing an overall structure of the printer 10 orientated in the upright position.

FIG. 2 shows the printer 10 orientated in the upright position on the installation surface S.

The shaft 24 rotatably supporting the frame 22 is provided with a helical torsion spring 56. One end of the helical torsion spring 56 is fixed to the frame 22, and the other end is fixed to the main body of the casing 12. The helical torsion spring 56 is disposed such that its restoring force acts in the direction of rotating the frame 22 counterclockwise about the shaft 24 with respect to the main body of the casing 12.

When the printer 10 is orientated in the horizontal position as shown in FIG. 1, the frame 22 makes contact with the installation surface S. Hence, the frame 22 is housed in the main body of the casing 22 withstanding the restoring force of the helical torsion spring 56, due to the own weights of the components of the printer 10 except for the frame 22 and other members directly or indirectly attached to the frame 22.

On the other hand, when the printer 10 is orientated in the upright position as shown in FIG. 2, the frame 22 is not restrained by the installation surface S (i.e. does not make contact with the installation surface S). Hence, the frame 22 is rotated counterclockwise about the shaft 24 due to the restoring force of the helical torsion spring 56. The main body of the casing 12 is provided with a stopper (not depicted) for restricting the rotative angle of the frame 22. Due to the function of the stopper, the frame 22 when rotated will be stopped at the position shown in FIG. 2.

When the printer 10 is in the upright position, the auxiliary catch tray 48B (FIG. 1) is detached, and instead a plate-like catch tray 58 is attached to the casing 12. When the printer 10 is in the upright position, the recording sheets P on which images have been formed are ejected to the catch tray 58 by the pair of ejection rollers 38.

Since the image formation processing is the same regardless of whether the printer 10 is in the upright position or in the horizontal position, the description thereof is omitted.

Next, the details of a paper feed device 50 including the paper feed tray 14 are described with reference to FIGS. 3A through 3C. FIG. 3A is an enlarged view of the first tray 16 and its vicinity shown in FIG. 1. Note that the first tray 16 serves as a platform to be stacked with a plurality of recording sheets. FIG. 1 shows the first tray 16 under the condition that the recording sheets P have been set in the paper feed tray 14 (the first tray 16), and FIG. 3A shows the first tray 16 under the condition that the recording sheets P are being picked up by the pickup roller 32. In FIG. 3, a smaller amount of the recording sheets P is loaded compared to FIG. 1.

A helical compression spring 52 is provided under the bottom surface of the lift-up plate 16A (i.e. opposite the surface on which the recording sheets P are loaded). The helical compression spring 52 is provided in the midpoint of the lift-up plate 16A with respect to the widthwise direction of the lift-up plate 16A (i.e. in the perpendicular direction to the drawing sheet). Note that two helical compression springs may be provided at equal intervals from the midpoint of the lift-up plate 16A with respect to the above-described widthwise direction (i.e. in the perpendicular direction to the drawing sheet). Such a structure keeps the pressure to the lift-up plate 16A uniform with respect to the above-described widthwise direction. As a result, the stated structure prevents the lift-up plate 16A from inclining due to ununiform pressure with respect to the widthwise direction, and prevents skewing or the like of the recording sheets as much as possible.

One end of the helical compression spring 52 is in contact with the bottom surface of the lift-up plate 16A, and presses the lift-up plate 16A toward the pickup roller 32.

The other end of the helical compression spring 52 is received by a receiver 54.

The receiver 54 includes a bottomed cylindrical portion 54A and a flange 54B provided around the open end of the cylindrical portion 54A. The other end of the helical compression spring 52, received by the receiver 54, is inserted in the bottomed cylindrical portion 54A.

The receiver 54 also includes a protrusion 54C that protrudes perpendicularly from the external bottom surface of the bottomed cylindrical portion 54.

The frame 22 as a part of the casing 12 is provided with a cylindrical hole 22A by which the inside and the outside of the frame 22 (i.e. the casing 12) are communicated. The bottomed cylindrical portion 54 of the receiver 54 is inserted into the cylindrical hole 22A. The inside diameter of the cylindrical hole 22A and the outside diameter of the bottomed cylindrical portion 54A are designed such that the bottomed cylindrical portion 54A can be smoothly inserted into the cylindrical hole 22A and does not rattle.

When the printer 10 is orientated in the horizontal position (FIG. 1), the protrusion 54C of the receiver 54 makes contact with the installation surface S, and thus the protrusion 54C enters inside the casing 12 (the frame 22). The helical compression spring 52 provided between the receiver 54 and the lift-up plate 16A is deformed from its free length, which is regarded as the original length, to the length shown in FIG. 3A, and generates pressure according to the amount of deformation.

The lift-up plate 16A is pressed toward the pickup roller 32 by the pressure, and the front end of the recording sheets P are pressed against the pickup roller 32.

Under such a condition, when the pickup roller 32 is rotated in the direction indicated by the arrow B, the uppermost recording sheet P in contact with the pickup roller 32 is picked up and transported downstream in the transport direction. Since a separation pad 60 is provided, if the second uppermost sheet, the third uppermost sheet, and so on are picked up together with the uppermost recording sheet P, the separation pad 60 prevents the recording sheets from being transported together.

Resisting the gravity acting on the first tray 16 and the recording sheets P (i.e. the self-weight thereof), the lift-up plate 16A presses the recording sheets P against the pickup roller 32 with a preferable amount of force. As a result, the pickup roller 32 picks up the recording sheets P one at a time from the uppermost sheet due to the function of the separation pad 60.

However, if the orientation of the printer 10 is changed from the horizontal position to the upright position without any structural change, the gravity acting on the first tray 16 and the recording sheets P will be insufficient to resist the pressure (i.e. the restoring force) of the helical compression spring 52. As a result, the pressure, by which the recording sheets P is pressed against the pickup roller 32, will be too greater than required. Therefore, the force applied by the pickup roller 32 to the second uppermost sheet, the third uppermost sheet, and so on of the recording sheets P will also be great, and the separation pad cannot prevent the sheets from being conveyed.

In view of this problem, the present embodiment adjust the length of the helical compression spring 52 to be longer in the upright position than in the horizontal position (i.e. adjust the amount of deformation of the helical compression spring 52) in order to reduce the pressure (i.e. the restoring force) of the helical compression spring 52, and thereby adjusts the force of pressing the recording sheets P against the pickup roller 32. Thus, the present invention prevents the second uppermost sheet, the third uppermost sheet and so on from being transported together with the uppermost recording sheet.

Figure 3C:
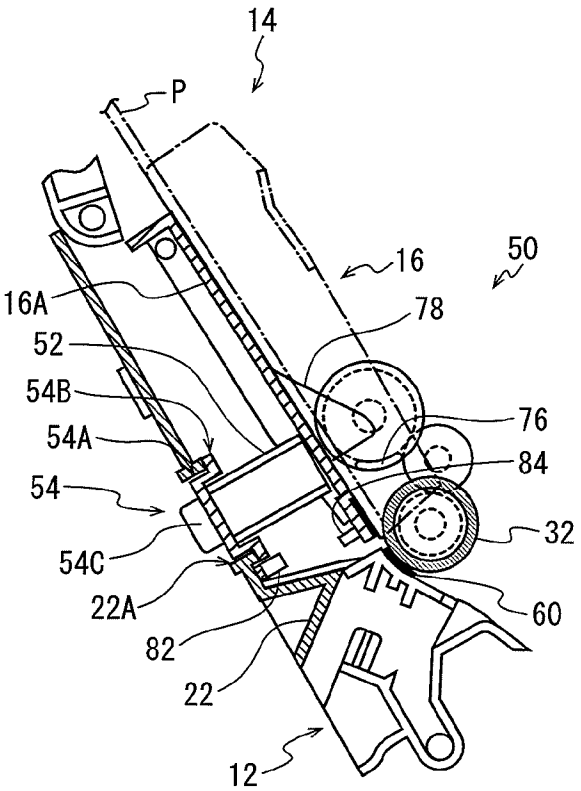
FIGS. 3A through 3C are enlarged views of a first tray and its vicinity of the printer 10, where
Figure 3A:
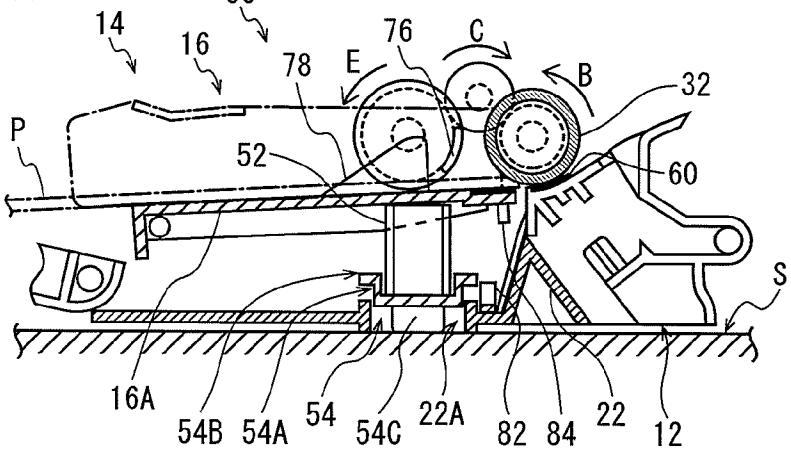

FIG. 3C is an enlarged view of the first tray 16 and its vicinity of the printer 10 orientated in the upright position.

As shown in FIG. 3C, the protrusion 54C of the receiver 54 is not restricted from moving (by the installation surface S), and therefore protrudes from the frame 22 (i.e. the casing 12). That is, when the orientation of the printer 10 is changed from the horizontal position shown in FIG. 3A to the upright position, the receiver 54 moves in the longitudinal direction of the helical compression spring 52, and the length of the helical compression spring 52 increases according to the movement of the receiver 54.

Here, the receiver 54 moves until the flange 54B reaches the edge of the cylindrical hole 22A in the frame 22. That is, the cylindrical hole 22A serves as a restriction member that controls the amount of protrusion of the receiver 54 (i.e. the protrusion 54C) protruding outward from the frame 22 (i.e. the casing 12).

With such a structure, when the printer 10 is in the upright position, the pressure (i.e. the restoring force) of the helical compression spring 52 is smaller than when the printer 10 is in the horizontal position. Thus, the force of pressing the recording sheets P against the pickup roller 32 will be adjusted to an appropriate amount when the printer 10 is in the upright position.

Next, the case of setting the recording sheets P into the paper feed tray 14 and the case of continuously feeding the recording sheets P are described with reference to FIG. 3B.

Figure 3B:
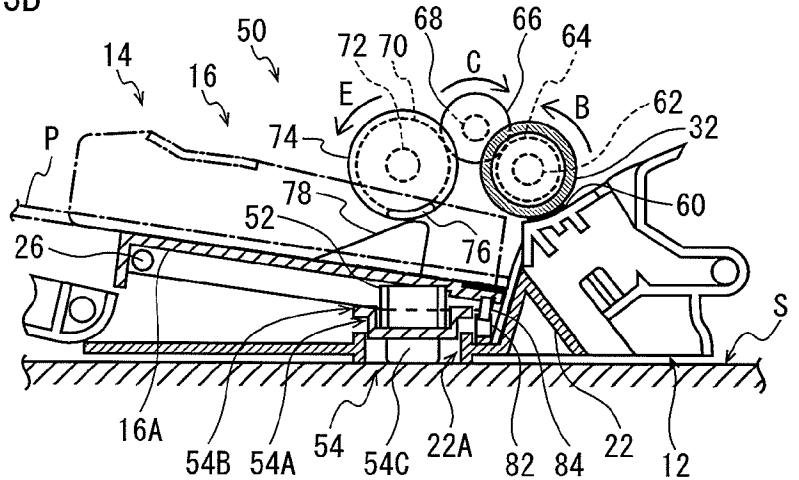

FIG. 3B shows that the first tray 16 has been forcibly rotated clockwise about the shaft 26, resisting the pressure (i.e. the restoring force) of the helical compression spring 52, with a gap secured between the pickup roller 32 and the end of the first tray 16 closer to the pickup roller 32 than the other end. Due to the gap, the end of the recording sheets P can be inserted between the first tray 16 and the pickup roller 32, and thus the recording sheets P can be set in the paper feed tray 14.

The following explains the mechanism for rotating the first tray 16 clockwise about the shaft 26.

The pickup roller 32 is attached to the shaft 62. As the shaft is rotated by a motor (not depicted) as a drive source, the pickup roller 32 is rotated together with the shaft 62.

A spur gear is attached to the shaft 62 near the rear side of the apparatus with respect to the depth direction of (i.e. the perpendicular direction to) the drawing sheet, and a spur gear 66 engaged with the spur shaft 64 is attached to the shaft 68. Also, a spur gear 70 engaged with the spur gear 66 is attached to the shaft 72.

A disc 74, which is concentric with the shaft 72, is attached to the shaft 72 to be closer than the spur gear 70 to the front side of the apparatus with respect to the depth direction of the drawing sheet. A cam 76 is formed on a main surface of the disc 74, which is the closer surface to the front side of the apparatus with respect to the depth direction of the drawing sheet. The disc 74 attached to the shaft 72 with an electromagnetic clutch (not depicted) placed between them, and the transmission of the rotative force from the shaft 72 to the disc 74 is enabled or disabled by the electromagnetic clutch. The cam 76 stands on the above-mentioned main surface of the disc 74, and has an arc-like shape extending along the periphery of the main surface of the disc 74. The cam 76 has a constant width in the radial directions. As the shaft 72 is rotated, the cam 76 is rotated along a circular path about the axis of the shaft 72.

A rectangular triangle plate 78 is provided to stand on a main surface of the lift-up plate 16A of the first tray 16, which is the closer surface to the rear end of the apparatus in the depth direction of the drawing sheet. The triangle plate 78 repeatedly goes inside and outside the circular path, and serves as a follower of the cam 76.

As the shaft 62 is rotated by the motor (not depicted) in the direction indicated by the arrow B, the driving force is transmitted to the shaft 72 via the spur gear 64, the spur gear 66, and the spur gear 70. Consequently, the cam 76 is rotated in the direction indicated by the arrow E. When the cam 76 is rotated under the condition that the triangle plate 78 is located inside the above-mentioned circular path as shown in FIG. 3A, the outer circumferential surface of the cam 76 contacts with the slope of the triangle plate 78 after a while, and presses down the triangle plate 78, resisting the pressure of the helical compression spring 52. As a result, the press-up plate 16A (the first tray 16) is rotated about the shaft 26 until the cam 76 reaches the bottom dead point as shown in FIG. 3B.

A photo interrupter 82 and a light-shield 84 are provided for detecting that the first tray 16 is located as shown in FIG. 3B. The photo interrupter 82 is provided on the frame 22, and the light-shield 84 is provided on the surface of the lift-up plate 16A opposite the loading surface loaded with the recording sheets P. The recording sheets P are set in the paper feed tray 14 under the condition that the first tray 16 is stopped in the position shown in FIG. 3B.

Hereinafter, the position of the first tray 16 shown in FIG. 3B is referred to as "the setting position" and the position of the first tray 16 shown in FIG. 3A is referred to as "the paper-feed position".

Next, description is given to the case of continuously feeding the recording sheets P which have been set.

Note that the rotation of the motor (not depicted) for driving the pickup roller 32 is under control of a controller (not depicted) provided in the printer 10. The controller switches between ON and OFF of the motor, and ON and OFF of the electromagnetic clutch (not depicted) based on the result of the detection by the photo interrupter 82.

While the printer 10 is not performing image formation, the first tray 16 is being stopped in the setting position.

(i) When performing image formation, the printer 10 starts up the motor to rotate the pickup roller 32. During the image formation, the pickup roller 32 keeps on rotating.

(ii) The controller switches between ON and OFF of the electromagnetic clutch so as to rotate the cam 76 once. While the cam 76 is being rotated once, the lift-up plate 16A lifts up the recording sheets P toward the pickup roller 32 by the pressure from the helical compression spring 52, and thus the recording sheets P are pressed against the pickup roller 32. As a result, the uppermost sheet of the recording sheets P is picked up by the pickup roller 32.

(iii) A sheet sensor is provided between the pickup roller 32 and the photosensitive drum 34. The sheet sensor (not depicted) detects the front end and the rear end of a recording sheet that is being transported. When the sheet sensor detects the front end of the recording sheet, an electrostatic latent image is written onto the photosensitive drum 32 (i.e. the exposure is started).

(iv) When the sheet sensor detects the rear end of the recording sheet, the controller turns on the electromagnetic clutch with a predetermined interval after the transportation of the recording sheet, and thus the cam 76 is rotated once and the next recording sheet will be fed.

The operations (i) through (iv) are repeated until a desired number of recording sheets will be fed.

Embodiment 2

According to Embodiment 1, the full length of the helical compression spring 52 automatically changes according to whether the printer 10 is orientated in the horizontal position or in the upright position, due to the receiver 54 (the protrusion 54C) that protrudes from, or becomes embedded in, the hole provided in the casing 12 (i.e. the frame 22). Thus, the force of pressing the recording sheets P against the pickup roller 32 automatically changes.

In Embodiment 2 in contrast, the full length of the helical compression spring 52, i.e., the pressure of the helical compression spring 52 is changed according to the user's operation associated with whether the printer 10 is in the horizontal position or in the upright position.

Figure 4B:
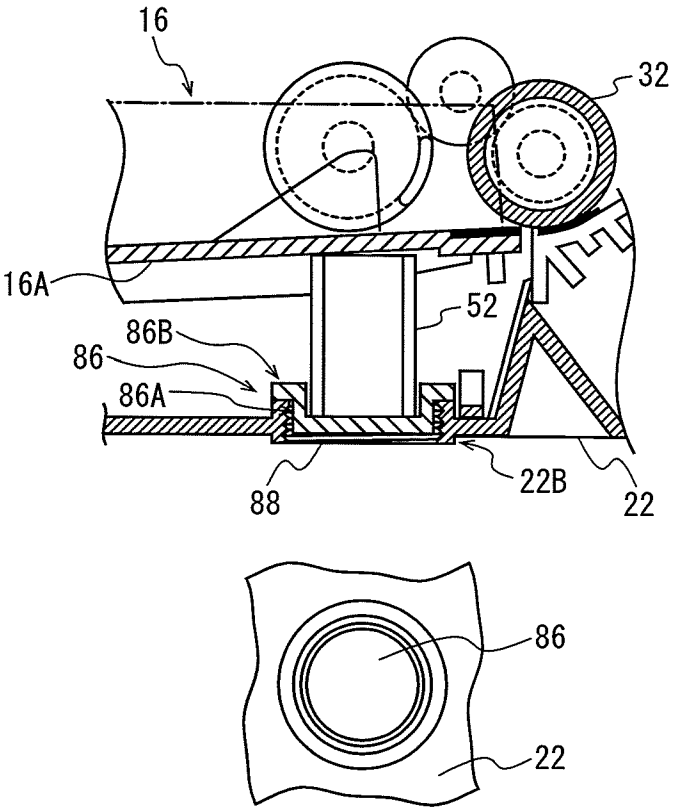
FIGS. 4A and 4B are enlarged views of a helical compression spring and its vicinity of the printer 10 pertaining to Embodiment 2, where
Figure 4A:
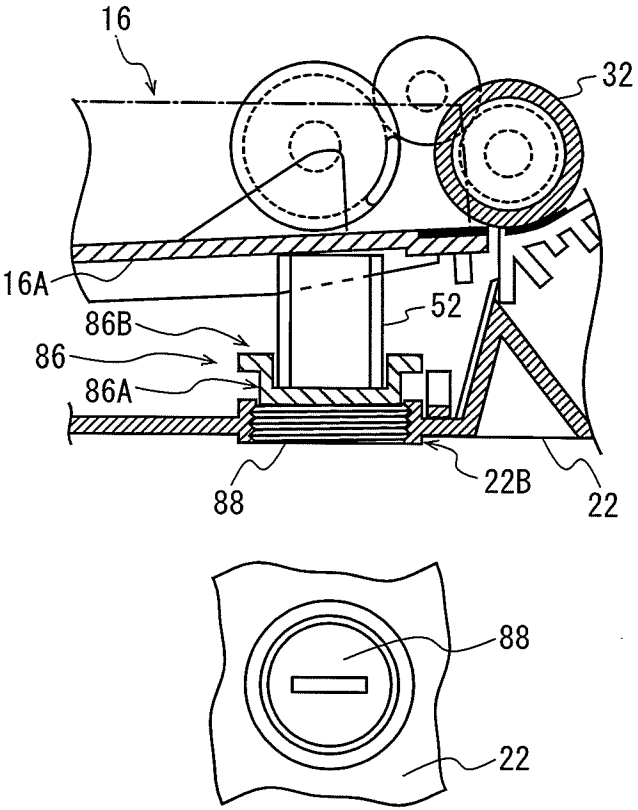
Figure 5B:
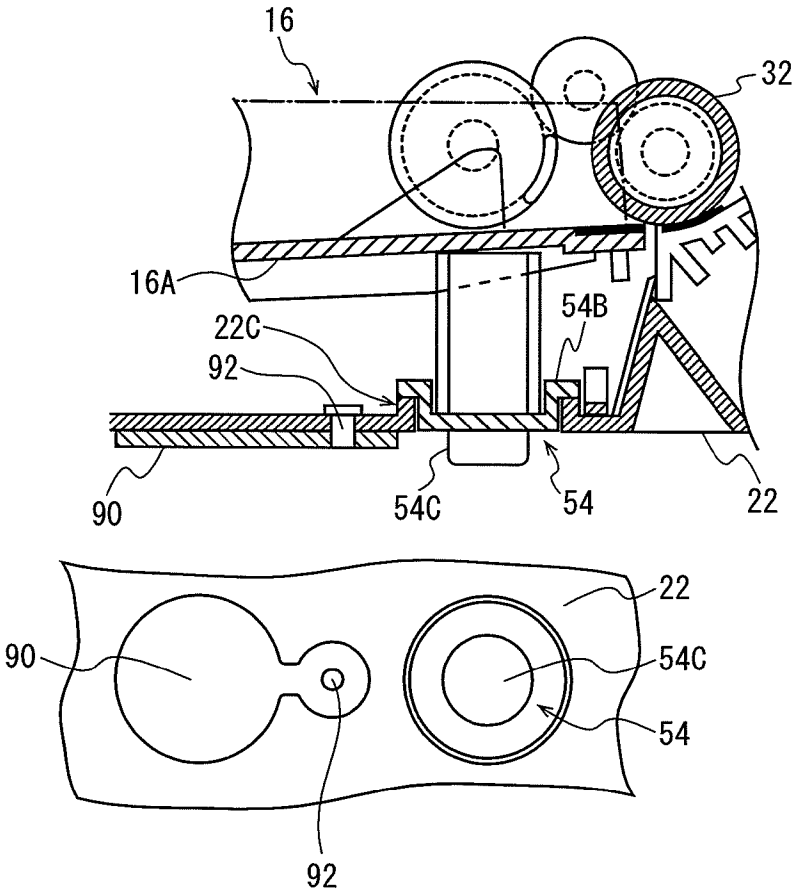
FIGS. 5A and 5B are enlarged views of a helical compression spring and its vicinity of the printer 10 pertaining to Embodiment 3, where
Figure 5A:
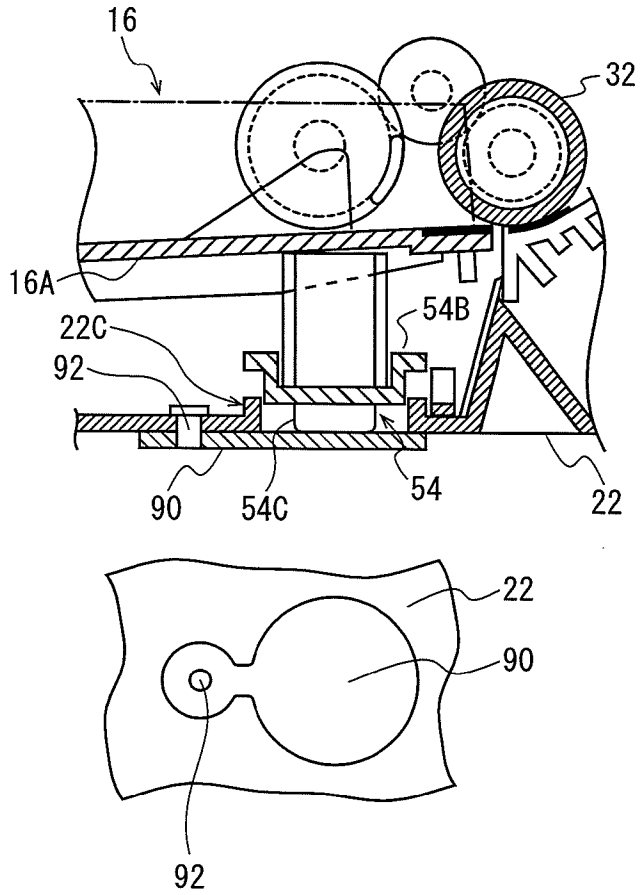

In each of FIG. 4A and FIG. 4B, the upper drawing is the front view of the helical compression spring 52 and its vicinity of the printer 10 pertaining to Embodiment 2, and the lower drawing shows the bottom surface of the same. In Embodiment 2, the substantially same components as Embodiment 1 are given the same reference numbers, and their descriptions are omitted or simplified.

In Embodiment 2, a receiver 86 has a different shape than the receiver 54 of Embodiment 1 in that the protrusion 54C is removed, and includes a bottomed cylindrical portion 86A and a flange 86B.

The frame 22 is provided with a cylindrical hole 22B instead of the cylindrical hole 22A of the Embodiment 1. The inner circumferential surface of the cylindrical hole 22B is provided with a female screw.

A screw lid 88 engages with the female screw. When installing the printer 10 in the horizontal position, the user engages the screw lid 88 with the female screw in advance so as to push the receiver 86 inside the casing 22 with the screw lid 88, and thus reduces the full length of the helical compression spring 52. On the other hand, when installing the printer 10 in the upright position, the user removes the screw lid 88. As a result, the full length of the helical compression spring 52 increases until the flange 86B of the receiver 86 makes contact with the end surface of the cylindrical hole 22B.

According to Embodiment 2, the pressure of the helical compression spring 52 can be surely adjusted for the use in the horizontal position even when the installation surface has a depression and the receiver 86 of the printer 10 orientated in the horizontal position is located in the depression.

Embodiment 3

In Embodiment 2, similar to Embodiment 2, the full length of the helical compression spring 52, namely, the pressure of the helical compression spring 52 is changed according to the user's operation associated with whether the printer 10 is in the horizontal position or in the upright position.

In Embodiment 3, a rotative lid 90 is provided instead of the screw lid 88 pertaining to Embodiment 2. The rotative lid 90 is composed of connected two discs having different sizes, and the smaller disc is rotatably supported on the frame 22 about the pin 92.

The cylindrical hole 22C provided in the frame 22 protrudes only inside the casing 12 (frame 22).

When orientating the printer 10 in the horizontal position, the user rotates the rotative lid 90 while pushing the protrusion 54C of the receiver 54 inside the frame 22 with his/her finger or the like, until the cylindrical hole 22C will be covered with the larger disc. Thus, the receiver 54 will be housed inside the casing 22. On the other hand, when orientating the printer 10 in the upright position, the user rotates the rotative lid 90 to uncover the cylindrical hole 22C. As a result, the full length of the helical compression spring 52 increases until the flange 54B of the receiver 54 makes contact with the end surface of the cylindrical hole 22C.

Embodiment 4

According to Embodiment 4, a linear motion cam is used for moving the receiver in the axial direction of the helical compression spring 52.

Figure 6A:
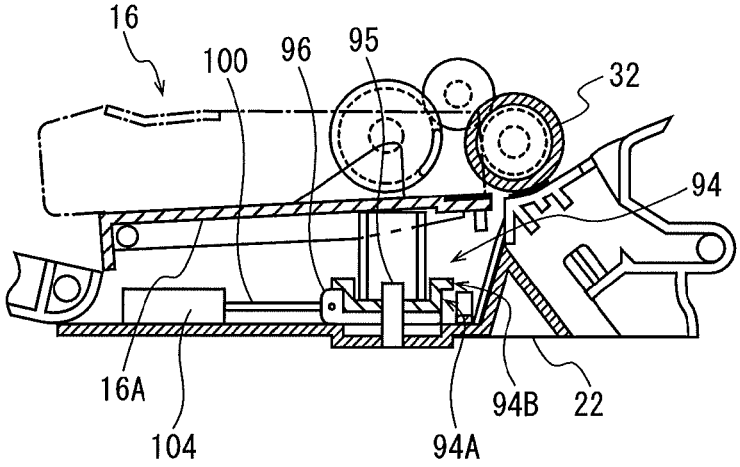
FIGS. 6A through 6C are enlarged views of a first tray and its vicinity of the printer 10 pertaining to Embodiment 4, where
Figure 6B:
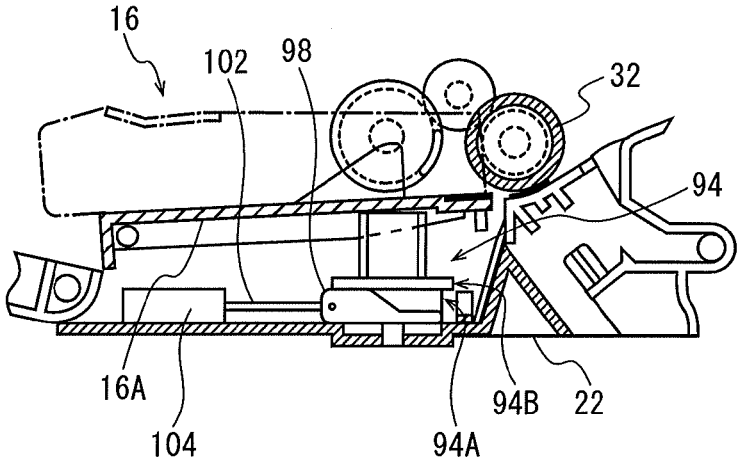
Figure 6C:
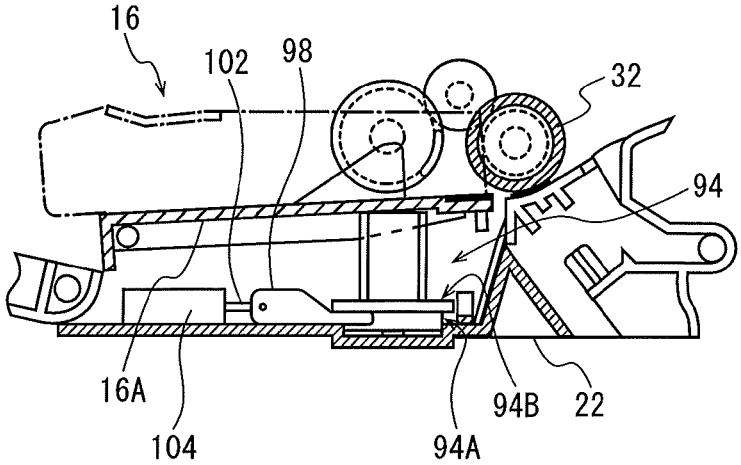

FIGS. 6A through 6C show the first tray 16 and its vicinity of the printer 10 pertaining to Embodiment 4. FIGS. 6A through 6C are illustrated in the same manner as FIGS. 3A through 3C of Embodiment 1. In Embodiment 4, the substantially same components as Embodiment 1 are given the same reference numbers, and their descriptions are omitted or simplified.

In Embodiment 4, a receiver 94 includes a bottomed cylindrical portion 94A and a flange 94B. The flange 94B is square-shaped. The bottom of the receiver 94 is provided with a through hole. Just under the through hole, a guide pin 95 is provided on the frame 22. The guide pin 95 is inserted in the through hole, the receiver 94 is guided by the guide pin 95 so as to move up and down linearly.

A pair of linear motion cams 96 and 98 are provided between the frame 22 and opposing two sides of the flange 94B in the depth direction of the drawing sheet. FIG. 6A shows the linear motion cam 96 located on the rear end of the apparatus in the depth direction of the drawing sheet. FIG. 6B and FIG. 6C show the linear motion cam 98 located on the front end of the apparatus in the depth direction of the drawing sheet. The flange 94B is guided by the uneven upper surfaces (including higher and lower upper surfaces) of the linear motion cams 96 and 98, and serves as a follower of the cams 96 and 98.

A dual-rod solenoid 104 with two parallel rods 100 and 102 is provided on the left of the linear motion cams 96 and 98, and the rods 100 and 102 respectively connected to the linear motion cams 96 and 98.

When the printer 10 is orientated in the horizontal position, the rods 100 and 102 are set forward so that the flange 94B runs upon the higher upper surfaces of the linear motion cams 96 and 98 as shown in FIG. 6A and FIG. 6B. Thus, the full length of the helical compression spring 52 is reduced. On the other hand, when the printer 10 is orientated in the upright position, the rods 100 and 102 are set back so as to guide the flange 94B to the lower upper surface of the linear motion cams 96 and 98 as shown in FIG. 6C. Thus, the full length of the helical compression spring 52 is increased.

The above-described operations of the solenoid 104 may be performed according to input from a user via a position selection keys provided on an operation panel (not depicted) of the printer 10, including a "horizontal position" key and an "upright position" key. Alternatively, a gravity sensor for detecting the orientation of the printer 10 may be provided inside the casing 12. If this is the case, the control unit controls the operations according to whether the printer 10 is in the upright position or in the horizontal position.

Embodiment 5

In Embodiments 1 through 4, the pressure of the first tray 16 (the lift-up plate 16A) toward the pickup roller 32 is generated by using a single helical compression spring 52. In contrast, Embodiment 4 uses a plurality of helical compression springs 52 (four springs in this example).

Figure 7A:
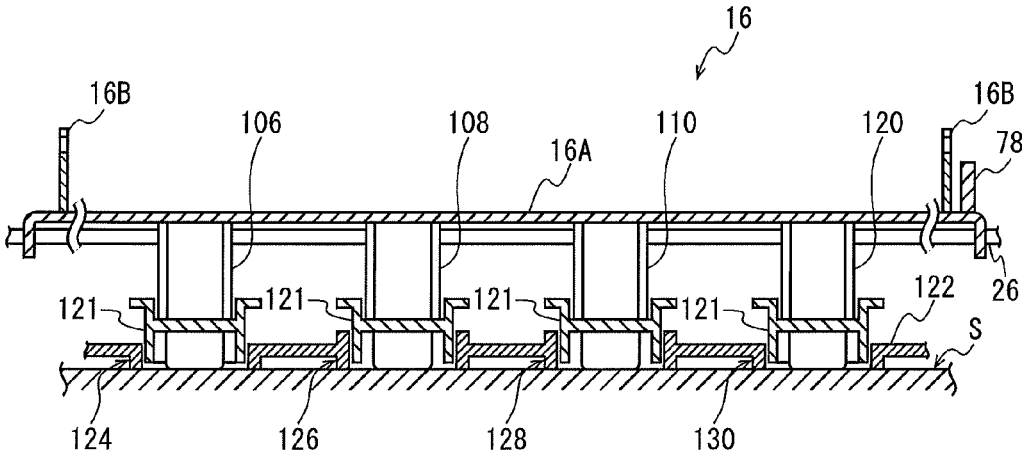
FIGS. 7A and 7B are cross-sectional views of a first tray and its vicinity of the printer 10 pertaining to Embodiment 5 along the widthwise direction of the first tray (i.e. the perpendicular direction to the transport direction of the recording sheets), where
Figure 7B:
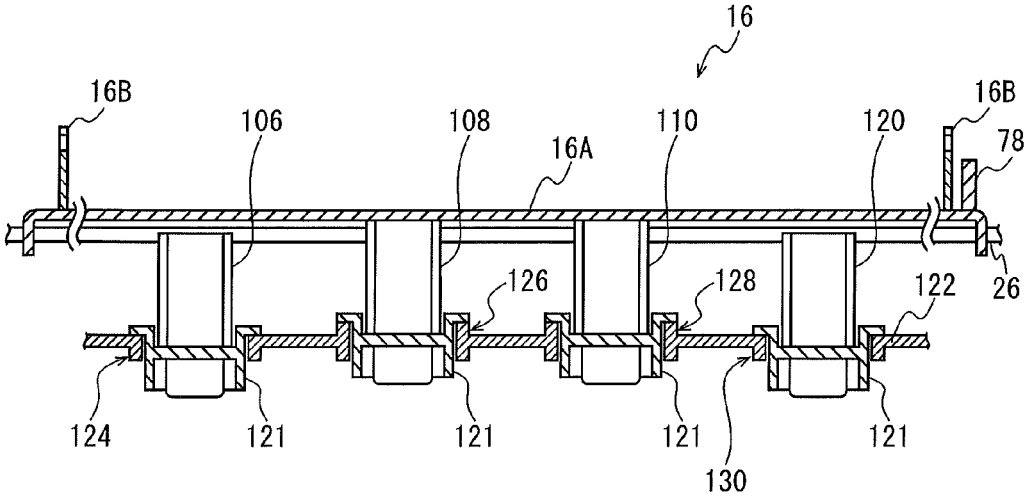

FIGS. 7A and 7B are cross-sectional view of the first tray 16 and its vicinity along the widthwise direction of the first tray 16 (i.e. the perpendicular direction to the transport direction of the recording sheets). FIG. 7A shows the case where the printer 10 is orientated in the horizontal position and FIG. 7B shows the case where the printer 10 is orientated in the upright position. For simplification, each cross-sectional view only shows the components that are necessary for explaining the overview of the Embodiment 5, and does not show all the components seen behind them. In addition, the substantially same components as Embodiment 1 are given the same reference numbers, and their descriptions are omitted or simplified.

As shown in FIGS. 7A and 7B, four helical compression springs 106, 108, 110 and 120 are provided along the widthwise direction of the first tray 16. The helical compression springs 106, 108, 110 and 120 are all the same. The free lengths of the helical compression springs 106, 108, 110 and 120 are same as the helical compression spring 52 of Embodiments 1 through 4, but their spring constant is smaller than the helical compression spring 52.

The bottomed cylindrical portion of each of the receivers 121 corresponding to the helical compression springs 106, 108, 110 and 120 is a little longer than the bottomed cylindrical portion 54A of the receiver 54 (FIG. 3) of Embodiment 1.

A plurality of cylindrical holes are provided in the frame 122. Among them, two cylindrical holes 126 and 128 in the center, which correspond to the helical compression springs 108 and 110, have the same shape as the cylindrical hole 22A of Embodiment 1. The other two helical compression springs 106 and 120 on the edges, which correspond to the helical compression springs 106 and 120, have a different shape than the cylindrical hole 22A of Embodiment 1 in that the protrusion extending inside the frame (the casing 12) is removed.

In the above-described structure of Embodiment 5, the functions of the central two helical compression springs 108 and 110 when the printer 10 is orientated in the horizontal position (FIG. 7A) and in the upright position (FIG. B) are the same as in Embodiment 1. The difference is that when the printer 10 is in the upright position, the helical compression springs 106 and 120 on the ends restore their free lengths and do not press against the lift-up plate 16A. When the printer 10 is in the horizontal position, the helical compression springs 106 and 120 press against the lift-up plate 16A.

According to Embodiment 5, among the four helical compression springs 106,108,110 and 120 that apply pressure when the printer 10 is in the horizontal position, the two helical compression springs 106 and 120 do not apply pressure when the printer 10 is in upright position, and the pressure applied by the other helical compression springs 108 and 110 is adjusted according to whether the printer 10 is in the horizontal position or in the upright position.

In the above-described example, the pressure applied by the helical compression springs 108 and 110 is changed according to whether the printer 10 is in the horizontal position or in the upright position. However, the full length of the helical compression springs 108 and 110 (when compressed), that is, the pressure applied by them may be constant regardless of whether the printer 10 is in the horizontal position or in the upright position, and the total amount of the pressure may be adjusted by changing whether or not to use the two helical compression springs 106 and 120 for applying the pressure.

Although the image forming apparatus pertaining to the present invention has been described above based on the embodiments, the present invention should not be limited to the embodiments. For example, the following modifications may be applied to the embodiments.

(1) As described above, the printer 10 is usable in both the horizontal position and the upright position. In the horizontal position, the paper feed tray for storing recording sheets and the catch tray for receiving recording sheets on which images have been formed are placed in their vertical positions so as to be located one above the other. In the upright position, the paper feed tray and the catch tray are placed in their upright positions so as to be located side by side. Such a structure has been conceived of as a result of consideration of the space occupied by the apparatus in an office or home. The Apparatus having such a structure is orientatable not only in the horizontal position that occupies large floor space, but also in the upright position that is different from the horizontal position in inclination with reference to the horizontal plane by 90° and occupies smaller floor space than in the horizontal position.

However, the orientation of the printer 10 is not limited to the horizontal position or the upright position. The printer 10 may be orientated in an intermediate position between the horizontal position and the upright position. For example, the printer 10 may be positioned on a V-shaped jig so that one surface of the printer 10 that faces the floor when the printer 10 is in the horizontal position and another surface of the printer 10 that faces the floor when the printer 10 is in the upright position are supported by the two surfaces of the groove of the V-shaped jig.

If this is the case, the full length of each helical compression spring (i.e. the pressure) while feeding the recording sheets is adjusted according to the inclination with reference to a horizontal plane. An appropriate full length can be obtained by experiments.

(2) In above-described embodiments, helical compression springs are used as a pressing member that presses the first tray (the lift-up plate) against the pickup roller. However, the present invention should not be limited in this way, and a plate spring may be used instead. Alternatively, a helical tension spring may be used. If this is the case, the helical tension spring pulls the lift-up plate toward the pickup roller so that the lift-up plate applies pressure against the pickup roller.

(3) Furthermore, the pressing member is not limited to springs, and other elastic material such as sponge or rubber may be used.

(4) The above-described embodiments only show applications of the present invention to a printer as an example. However, the present invention is not limited to a printer, and may be applied to a facsimile machine, or a multifunction peripheral having their functions.

(5) The above-described embodiments only show applications of the present invention to an electrophotographic image forming apparatus (printer) as an example. However, the image forming apparatus pertaining to the present invention is not limited to an electrophotographic apparatus. For example, the present invention is applicable to an ink jet image forming apparatus.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. An image forming apparatus that is orientatable in either a first position or a second position, the second position being different from the first position in inclination with respect to a horizontal plane, comprising:

a platform configured to be stacked with a plurality of recording sheets used for image formation;

a pickup roller in contact with the recording sheets and configured to pick up the recording sheets one at a time;

a pressing member applying pressure to the platform against the pick-up roller, wherein the pressing member is made from a helical compression spring; and a pressure changer causing the pressing member to change an amount of the pressure according to whether the image forming apparatus is in the first position or in the second position;

the pressure changer includes:

a receiver that receives one end of the helical compression spring farther from the platform than the other end thereof is, and freely moves through a hole provided in a surface of a casing of the image forming apparatus so that a portion of the receiver protrudes from, or becomes embedded in, the hole; and a restriction member that controls an amount of protrusion of the portion of the receiver, when the image forming apparatus is in the first position, the surface with the hole faces an installation surface on which the image forming apparatus is installed, and when the image forming apparatus is in the second position, another surface of the casing than the surface with the hole faces the installation surface, when the image forming apparatus is in the first position, the portion of the receiver is embedded in the hole by being pressed by the installation surface and the helical compression spring is compressed, and when the image forming apparatus is in the second position, the portion of the receiver protrudes from the hole, and the helical compression spring is less compressed than when the image forming apparatus is in the first position, and thus the pressure changer deforms the pressing member less than when the image forming apparatus is in the first position.

2. The image forming apparatus of claim 1, wherein the pressing member is made up from a plurality of elastic parts each changing an amount of pressure according to an amount of deformation from an original shape thereof, and the pressure changer deforms all the elastic parts when the image forming apparatus is in the first position, and deforms some of the elastic parts when the image forming apparatus is in the second position so as to apply a smaller amount of pressure to the platform, relative to when the image forming apparatus is in the first position.

* * * * *